US006893022B2

(12) United States Patent
Stahlecker

(10) Patent No.: US 6,893,022 B2
(45) Date of Patent: May 17, 2005

(54) ARRANGEMENT FOR SEALING AN OPENING OF A ROTOR HOUSING

(75) Inventor: Gerd Stahlecker, Eislingen/Fils (DE)

(73) Assignee: Maschinenfabrik Rieter, Winterthur (CH)

( * ) Notice: Subject to any disclaimer, the term of this patent is extended or adjusted under 35 U.S.C. 154(b) by 0 days.

(21) Appl. No.: 10/625,786

(22) Filed: Jul. 24, 2003

(65) Prior Publication Data

US 2004/0173970 A1 Sep. 9, 2004

(30) Foreign Application Priority Data

Aug. 7, 2002 (DE) ..... 102 37 040

(51) Int. Cl.[7] ..... F16J 15/447; F16C 33/76

(52) U.S. Cl. ..... 277/411; 277/412; 277/422; 384/488; 384/901

(58) Field of Search ..... 277/422, 913, 277/411–414, 406; 57/406, 414; 384/488, 480, 144, 901

(56) References Cited

U.S. PATENT DOCUMENTS 3,756,673 A * 9/1973 Strub ..... 384/117
4,475,736 A * 10/1984 Lesiecki ..... 277/422
4,598,913 A * 7/1986 Kotzur ..... 277/422
4,723,781 A * 2/1988 Turanskyj et al. ..... 277/347
5,299,813 A * 4/1994 McKenna ..... 277/422
5,828,148 A * 10/1998 Niggemann et al. ..... 310/86
6,095,529 A 8/2000 Stahlecker ..... 277/422

FOREIGN PATENT DOCUMENTS

DE 197 32 096 1/1999

* cited by examiner

*Primary Examiner*—Alison Pickard
*Assistant Examiner*—Vishal Patel
(74) *Attorney, Agent, or Firm*—Crowell & Moring LLP

(57) ABSTRACT

An arrangement for sealing an opening of a rotor housing in which a vacuum prevails, through which opening a shaft of a spinning rotor, supported outside of the rotor housing, projects. The arrangement has free floating sealing element arranged towards the opening and forming at least two sealing gaps with the spinning rotor. A first sealing gap is located between the sealing element and the shaft, a second sealing gap is located between the sealing element and a collar of the spinning rotor which borders the shaft. The sealing element can form an additional third sealing element with the back wall of the spinning rotor.

33 Claims, 1 Drawing Sheet

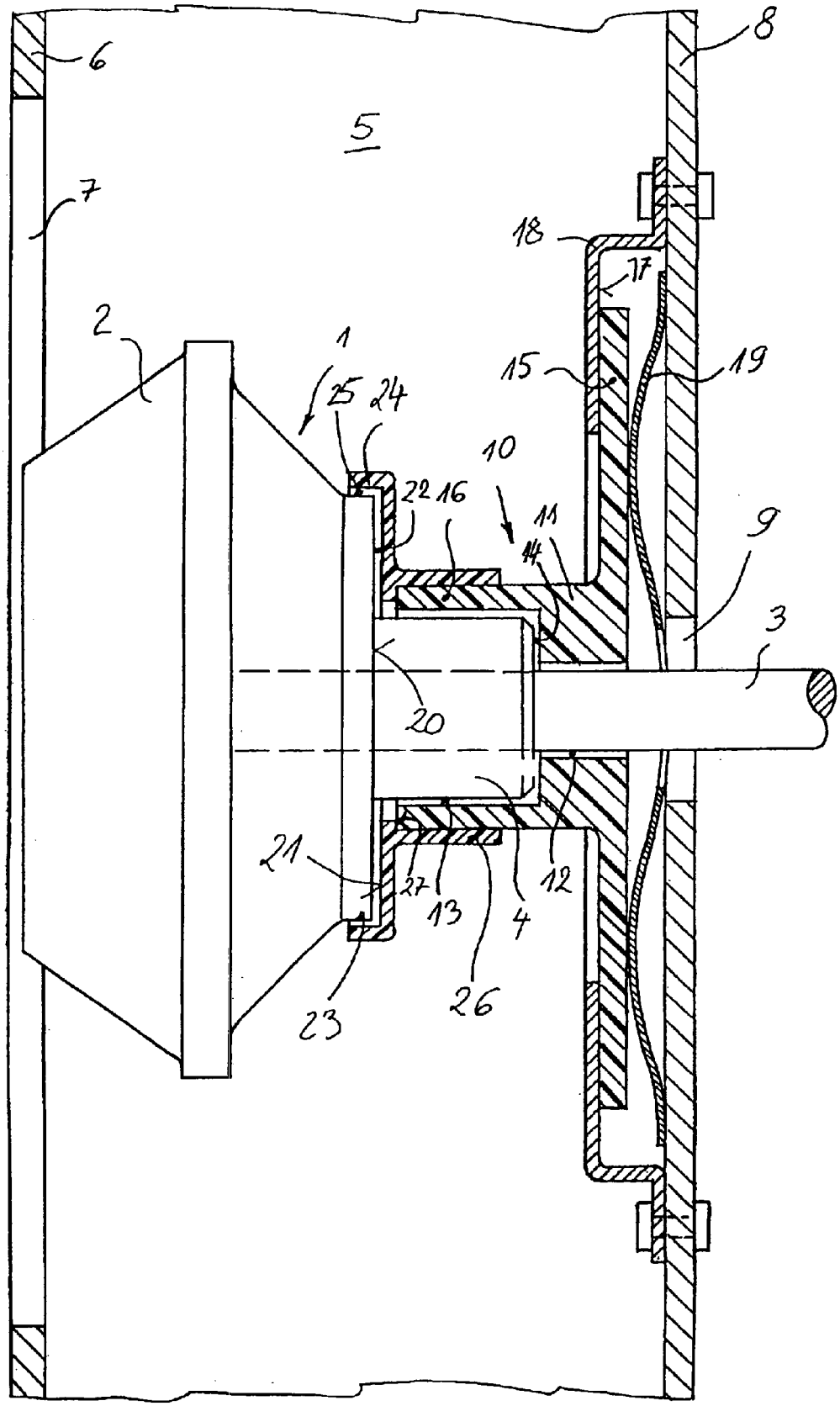
6
8
5
7
18
17
2
1
15
19
25
24
10
22
16
11
14
9
3
20
21
27
13
4
12
23
26

ARRANGEMENT FOR SEALING AN OPENING OF A ROTOR HOUSING

BACKGROUND AND SUMMARY OF THE INVENTION

This application claims the priority of German Application No. 102 37 040.0 filed Aug. 7, 2002, the disclosure of which is expressly incorporated by reference herein.

The present invention relates to an arrangement for sealing an opening of a rotor housing in which a vacuum prevails, through which opening a shaft, supported outside of the rotor housing, projects, said arrangement comprising at least two sealing gaps, of which a first sealing gap is formed between the shaft and a sealing element free floating in relation to the opening, while a second sealing gap is formed with a collar of the spinning rotor bordering on the shaft.

An arrangement of this type is prior art in German published patent application DE 197 32 096 (corresponding U.S. Pat. No. 6,095,529). The sealing element is in this case a free floating sealing disc, which seals the shaft from a ring-shaped component which is clipped onto the rotor housing. The second sealing gap is independent of the free floating sealing disc and is located between the collar of the spinning rotor and a plastic tube affixed in the rotor housing. Because of the combination of the two sealing gaps, a kind of labyrinth sealing occurs, which makes it difficult for unwanted air to enter into the rotor housing. Overall, a non-contact seal occurs, which permits, for example, the spinning rotor to be pulled out of its bearing towards the operator's side out of the open-end spinning aggregate. In order not to permit the two sealing gaps to become too large, despite this dismounting possibility of the spinning rotor, the through entry bore hole of the free floating sealing disc has a narrow tolerance in relation to the shaft, which in turn permits the sealing disc, as a result of its free floating arrangement, to center itself when the machine is set in operation.

Spinning rotors can operate today at speeds of approximately 150,000 rpm. Such high speeds are only possible when the distances between the shaft bearings are relatively short and in addition, when the part of the spinning rotor located in the rotor housing has only a relatively small overhang in relation to the next bearing. This has the result that in the known arrangement, the first sealing gap between the free floating sealing disc and the shaft is very short, so that the first bearing located outside of the rotor housing can be moved very close to the rotor housing.

It is an object of the present invention to make the sealing gap as long as possible in order to achieve as effective gap sealing as possible in an area where the sealing gap can be narrowly tolerated.

This object has been achieved in accordance with the present invention in that the second sealing gap is also formed with the same free floating arranged sealing element.

With preferred embodiments of the invention, the first sealing gap is extended by means of the second sealing gap, whereby in both cases one and the same sealing element acts together with the spinning rotor, that is once with the shaft and once with the collar. Thus both sealing gaps can be very narrowly tolerated. The sealing gap hereby becomes significantly more effective in preventing the entry of false air. With certain preferred relevant embodiments, an additional, radially extending sealing gap forms automatically at the end of the collar where it graduates over to the shaft.

The sealing element preferably comprises a radial flange which is disposed free floating with respect to a likewise radially formed supporting surface of the rotor housing, and also comprises a tube-like area arranged to the collar. The result is a preferably one-piece combined component for the free floating sealing element, which component can simultaneously run in at both sealing gaps when the machine starts up. It is hereby advantageous according to preferred embodiments when the radial flange is pressed against the support surface by at least one spring element. Although this is not strictly necessary due to the low pressure in the rotor housing, the spring element provides additional security, in particular when the spinning aggregate has to be opened for maintenance purposes and the low pressure collapses as a result.

In certain preferred embodiments of the present invention it is provided that the sealing element in addition comprises a sealing surface extending essentially radially and forming a third sealing gap with the rear wall of the spinning rotor. This sealing surface need not be absolutely radially arranged, but rather can be more or less conically formed. The free floating sealing element is in this way placed sufficiently close to the rotating spinning rotor, whereby the drawing in of air is rendered more difficult. A type of envelopment of the spinning rotor occurs, at least in part, at its rear wall, whereby, above all at high surface speeds, a reduction in energy consumption can be achieved. Because the sealing surface, being applied to the free floating sealing element, is also aligned according to the shaft, it can be placed accordingly close to the surface of the rear wall of the spinning rotor.

The said envelopment of the rear wall of the spinning rotor can be further improved when the sealing surface is provided with a hollow cylindrical extension which envelopes a cylindrical area of the rear wall. In combination with said gap sealing, a further, fourth sealing gap occurs due to this improved enveloping of the spinning rotor, namely between the hollow cylindrical extension of the free floating sealing element and the cylindrical area of the rear wall of the spinning rotor.

A particular advantage arises when the sealing surface can be arranged at an exchangeable part which is connectable to the sealing element. This exchangeable part, which can be connected in one piece with, but releaseable from, the free floating sealing element, can be adapted to various diameter areas of the spinning rotor. It is purposeful when the exchangeable part is pressed onto the tube-like area.

These and further objects, features and advantages of the present invention will become more readily apparent from the following description of a greatly enlarged embodiment of the present invention when taken in conjunction with the accompanying drawing.

BRIEF DESCRIPTION OF THE DRAWINGS

The single drawing FIGURE is a part sectional side view of an open-end spinning rotor with a sealing arrangement constructed according to a preferred embodiment of the invention.

DETAILED DESCRIPTION OF THE DRAWING

The drawing shows an axial intersection through an open-end spinning arrangement in the area of a spinning rotor assembly 1. This rotor assembly comprises a rotor cup 2 as well as a shaft 3. The rotor cup 2 is pressed onto the shaft 3 by means of a collar 4 in the known way.

During operation, the rotor cup 2 rotates in a vacuum chamber 5, which is formed by a rotor housing 6. The vacuum chamber 5 is connected to a vacuum source (not shown).

The front side of the rotor housing 6 comprises an operator's opening 7, which is closed during operation by means of a housing cover (not shown), so that false air cannot enter into the vacuum chamber 5. The rear wall 8 of the rotor housing 6 comprises an opening 9, through which the shaft 3 projects. The shaft 3 is supported outside of the rotor housing 6 in a way not shown and is driven to rotate.

In order to prevent false air from entering through the opening 9 into the vacuum chamber 5, a device 10 for sealing the opening 9 is provided. This device 10 comprises a sealing element 11 which is preferably made of plastic, which is arranged in a free floating way in relation to the opening 9, the shaft 3 and the collar 4. The free floating sealing element 11 forms a first sealing gap 12 with the rotating shaft 3 and a second sealing gap 13 with the also rotating collar 4. Thus both sealing gaps 12 and 13 act together with one and the same free floating sealing element 11 and can be particularly provided with close tolerances, as the sealing element 11 runs in during the initial start-up of the spinning rotor 1, thus causing the two sealing gaps 12 and 13 to form at the same time in the desired order of magnitude. Because of the free floating arrangement, the sealing element 11 is always sufficiently centered in relation to the spinning rotor 1. The first sealing gap 12 is extended to a certain degree by the second sealing gap 13, so that each single sealing gap 12, 13, taken individually, is kept to a sufficiently short length. The efficacy can be increased in that, given the corresponding embodiment between the rear facing side of the collar 4 and the arranged surface of the free floating sealing element 11, an additional, radially extending sealing gap 14 is formed. The presence of this additional sealing gap 14 is, however, not absolutely necessary for all preferred embodiments of the present invention.

The sealing element 11 comprises in one piece a radial flange 15 and a tube-like area 16. The radial flange 15 lies in a free floating position on a likewise radially aligned support surface 17 of the rotor housing 6. For assembly reasons, the support surface 17 is arranged on a separately mountable component 18, which is affixed to the rear wall 8 and thus forms a component part of the rotor housing 6. Although the vacuum prevailing in the vacuum chamber 5 pulls the radial flange 15 to the support surface 17 during operation, a spring element 19 is provided for extra security in certain preferred embodiments, which spring element 19 is supported on the one hand on the rear wall 8 and on the other hand on the radial flange 15 and thus presses the sealing element 11 to the support surface 17 of the rotor housing 6.

In addition to the radial flange 15 and the tube-like area 16, the free floating arranged sealing element 11 comprises a further part which forms together with a rear wall 20 of the spinning rotor 1 a third sealing gap 22, which extends essentially in radial direction. Thus a sealing surface 21 of the sealing element 11 acts together with said rear wall 20. The third sealing gap 22 need not extend absolutely radially, but can, in a way not shown, be formed with a conically extending rear wall of the spinning rotor 1. When this third sealing gap 22 is sufficiently closely tolerated, a reduction in energy consumption can be achieved, in particular at high spinning rotor 1 speeds. Because the sealing surface 21 is a component part of the free floating sealing element 11, it is aligned according to the shaft 3 and the collar 4, as described with the aid of the sealing gaps 12 and 13.

The measures for saving energy can be further improved if the sealing surface 21 is provided with a hollow cylindrical extension 24 which envelopes a cylindrical area 23 of the rear wall 20. Thus a further sealing gap 25 occurs with overall a certain degree of envelopment of the rotor cup 2.

In certain preferred embodiments of the present invention it is provided that the sealing surface 21 is arranged at an exchangeable part 26 which is connected to the sealing element 11 in a releasable way. This exchangeable part 26 can be pressed onto the tube-like area 16 of the sealing element 11 with the aid of an axial stopper 27. The application of various exchangeable parts permits the free floating sealing element 11 to be adapted to different diameter areas of the rotor cup 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sealing arrangement for a rotor housing for an open end spinning rotor having a rotor cup and a rotor shaft, wherein a vacuum prevails in said housing during spinning operations and said rotor housing is provided with an opening for the rotor shaft supported outside of said rotor housing, and wherein a first radial sealing gap is formed between the rotor shaft and a freely floating sealing element attached to the rotor housing and a second radial sealing gap is formed between the same freely floating sealing element and a collar of the rotor cup from which collar the rotor shaft extends.

2. An arrangement according to claim 1 wherein the sealing element comprises a radial flange, which is disposed on a radially aligned support surface of the rotor housing, and wherein the sealing element comprises a tube-like area arranged at the collar for defining the second sealing gap.

3. An arrangement according to claim 2, wherein the radial flange is pressed to the support surface by at least one spring element.

4. An arrangement according to claim 1, wherein the sealing element comprises an essentially radially extending sealing surface which together with a rear wall of the spinning rotor forms a third sealing gap.

5. An arrangement according to claim 2, wherein the sealing element comprises an essentially radially extending sealing surface which together with a rear wall of the spinning rotor forms a third sealing gap.

6. An arrangement according to claim 3, wherein the sealing element comprises an essentially radially extending sealing surface which together with a rear wall of the spinning rotor forms a third sealing gap.

7. An arrangement according to claim 4, wherein the sealing surface is provided with a hollow cylindrical extension which envelopes a cylindrical area of the rear wall.

8. An arrangement according to claim 5, wherein the sealing surface is provided with a hollow cylindrical extension which envelopes a cylindrical area of the rear wall.

9. An arrangement according to claim 6, wherein the sealing surface is provided with a hollow cylindrical extension which envelopes a cylindrical area of the rear wall.

10. An arrangement according to claim 4, wherein the sealing surface is arranged as an exchangeable part which is connectable to the sealing element.

11. An arrangement according to claim 5, wherein the sealing surface is arranged as an exchangeable part which is connectable to the sealing element.

12. An arrangement according to claim 6, wherein the sealing surface is arranged as an exchangeable part which is connectable to the sealing element.

13. An arrangement according to claim 7, wherein the sealing surface is arranged as an exchangeable part which is connectable to the sealing element.

14. An arrangement according to claim 8, wherein the sealing surface is arranged as an exchangeable part which is connectable to the sealing element.

15. An arrangement according to claim 9, wherein the sealing surface is arranged as an exchangeable part which is connectable to the sealing element.

16. An arrangement according to claim 10, wherein the exchangeable part is pressed onto a tube-like area of the sealing element.

17. An arrangement according to claim 11, wherein the exchangeable part is pressed onto said tube-like area of the sealing element.

18. An arrangement according to claim 12, wherein the exchangeable part is pressed onto said tube-like area of the sealing element.

19. An arrangement according to claim 13, wherein the exchangeable part is pressed onto a tube-like area of the sealing element.

20. An arrangement according to claim 14, wherein the exchangeable part is pressed onto said tube-like area of the sealing element.

21. An arrangement according to claim 15, wherein the exchangeable part is pressed onto said tube-like area of the sealing element.

22. A sealing arrangement according to claim 1, wherein said freely floating sealing element is made of plastic.

23. A sealing arrangement according claim 1, wherein said collar has a larger diameter than said rotor shaft.

24. A sealing arrangement according to claim 22, wherein said collar has a larger diameter than said rotor shaft.

25. A unitary sealing element operable in use to seal an open end spinning rotor assembly having a rotor shaft supporting a rotor cup with respect to flow of air through a housing opening which in use is penetrated by the rotor shaft, said unitary sealing element being a free floating sealing element which in use forms a first annular radial sealing gap between the rotor shaft and the sealing element and a second annular radial sealing gap between the sealing element and a ring collar connecting the rotor cup and rotor shaft.

26. A unitary sealing element according to claim 25, wherein the sealing element comprises a radial flange, which is disposed on an also radially aligned support surface of the housing, and which comprises a tube-like area arranged at the collar.

27. A unitary sealing element according to claim 25, wherein the sealing element comprises an essentially radially extending sealing surface which together with a rear wall of the spinning rotor forms a third sealing gap.

28. A unitary sealing element according to claim 26, wherein the sealing element comprises an essentially radially extending sealing surface which together with a rear wall of the spinning rotor forms a third sealing gap.

29. An arrangement for sealing an opening of a rotor housing in which a vacuum prevails, through which opening a shaft, supported outside of the rotor housing, projects, said arrangement comprising at least two sealing gaps, of which a first sealing gap is formed between the shaft and a sealing element free floating in relation to the opening, while a second sealing gap is formed with a ring collar of the spinning rotor bordering on the shaft, wherein the second sealing gap is also formed with the same free floating sealing element, wherein the sealing element comprises an essentially radially extending sealing surface which together with a rear wall of the spinning rotor forms a third sealing gap, and the sealing surface is provided with a hollow cylindrical extension which envelopes a cylindrical area of the rear wall.

30. An arrangement according to claim 29, wherein the sealing element comprises a radial flange, which is disposed on an also radially aligned support surface of the rotor housing, and which comprises a tube-like area arranged at the collar.

31. An arrangement according to claim 30, wherein the radial flange is pressed to the support surface by at least one spring element.

32. An arrangement according to claim 29, wherein the sealing surface is arranged at an exchangeable part which is connectable to the sealing element.

33. An arrangement for sealing an opening of a rotor housing in which a vacuum prevails, through which opening a shaft, supported outside of the rotor housing, projects, said arrangement comprising at least two sealing gaps, of which a first sealing gap is formed between the shaft and a sealing element free floating in relation to the opening, while a second sealing gap is formed with a ring collar of the spinning rotor bordering on the shaft, wherein the second sealing gap is also formed with the same free floating sealing element, wherein the sealing element comprises an essentially radially extending sealing surface which together with a rear wall of the spinning rotor forms a third sealing gap;

wherein the sealing surface is arranged as an exchangeable part which is connectable to the sealing element; and wherein the exchangeable part is pressed onto a tube-like area of the sealing element.

* * * * *